US005125492A

United States Patent [19]

Treleaven et al.

[11] Patent Number: 5,125,492

[45] Date of Patent: Jun. 30, 1992

[54] TOKEN OPERATED TELEVISION TIMER

[76] Inventors: David H. Treleaven, 3 Joseph Circle, Stittsville, Ontario, Canada, K2S 1B9; John M. McLean, 401-847 Hornby St., Vancouver, Canada

[21] Appl. No.: 650,719

[22] Filed: Feb. 4, 1991

[51] Int. Cl.[5] ..... G07F 15/12; H01H 43/00

[52] U.S. Cl. ..... 194/241; 307/141

[58] Field of Search ..... 307/141, 141.4, 141.8; 194/241, 240, 239, 218

[56] References Cited

U.S. PATENT DOCUMENTS

| | | | |
|---|---|---|---|
| 3,581,029 | 5/1971 | Noiles | 307/141 X |
| 3,833,779 | 9/1974 | Leone | 307/141 X |
| 3,879,332 | 4/1975 | Leone | 307/141 X |
| 4,246,495 | 1/1981 | Pressman | 307/141 |
| 4,541,519 | 9/1985 | Belviso et al. | 194/241 |
| 4,566,033 | 1/1986 | Reidenover | 194/241 X |
| 4,588,901 | 5/1986 | Maclay et al. | 307/141.4 X |
| 4,805,754 | 2/1989 | Howells | 194/317 |
| 4,821,862 | 4/1989 | Nelson | 194/241 |
| 4,838,404 | 6/1989 | Smith et al. | 194/212 |
| 5,033,603 | 7/1991 | Kai et al. | 194/334 |

FOREIGN PATENT DOCUMENTS

| | | | |
|---|---|---|---|
| 3229634 | 2/1984 | Fed. Rep. of Germany | 194/241 |
| 2187319 | 9/1987 | United Kingdom | 194/241 |

*Primary Examiner*—Robert J. Spar
*Assistant Examiner*—Scott L. Lowe

[57] ABSTRACT

A device to control the on/off operation of a television set. It is token activated with each of a number of tokens giving a fixed period of time. The device includes a case with a power cord, an electrical receptacle into which the television set power cord is plugged and secured, a token chute with a mechanism for detecting a passing token, and a token drawer with a lock. Inserted tokens are counted and periods of television time credited. Elapsed time is measured, and periods of elapsed time subtracted from credited time. The set is turned off when net credited time, which is displayed, becomes zero. There is a switch to turn off the set while retaining credited time. There is another switch to allow the set to be used without expending credited time.

5 Claims, 3 Drawing Sheets

| I/P | O/P | I/P | O/P | I/P | O/P | I/P | O/P |
|---|---|---|---|---|---|---|---|
| 00 | C0 | 74 | B0 | B0 | 79 | DA | B0 |
| | | 75 | A4 | B1 | 40 | DB | A4 |
| 10 | F9 | 76 | F9 | B2 | 98 | DC | F9 |
| 11 | C0 | 77 | C0 | B3 | 80 | DD | C0 |
| | | | | B4 | F8 | | |
| 20 | A4 | 80 | 80 | B5 | 83 | E0 | 19 |
| 21 | F9 | 81 | F8 | B6 | 92 | E1 | 30 |
| 22 | C0 | 82 | 83 | B7 | 99 | E2 | 24 |
| | | 83 | 92 | B8 | B0 | E3 | 79 |
| 30 | B0 | 84 | 99 | B9 | A4 | E4 | 40 |
| 31 | A4 | 85 | B0 | BA | F9 | E5 | 98 |
| 32 | F9 | 86 | A4 | BB | C0 | E6 | 80 |
| 33 | C0 | 87 | F9 | | | E7 | F8 |
| | | 88 | C0 | C0 | 24 | E8 | 83 |
| 40 | 99 | | | C1 | 79 | E9 | 92 |
| 41 | B0 | 90 | 98 | C2 | 40 | EA | 99 |
| 42 | A4 | 91 | 80 | C3 | 98 | EB | B0 |
| 43 | F9 | 92 | F8 | C4 | 80 | EC | A4 |
| 44 | C0 | 93 | 83 | C5 | F8 | ED | F9 |
| | | 94 | 92 | C6 | 83 | EE | C0 |
| 50 | 92 | 95 | 99 | C7 | 92 | | |
| 51 | 99 | 96 | B0 | C8 | 99 | F0 | 12 |
| 52 | B0 | 97 | A4 | C9 | B0 | F1 | 19 |
| 53 | A4 | 98 | F9 | CA | A4 | F2 | 30 |
| 54 | F9 | 99 | C0 | CB | F9 | F3 | 24 |
| 55 | C0 | | | CC | C0 | F4 | 79 |
| | | A0 | 40 | | | F5 | 40 |
| 60 | 83 | A1 | 98 | D0 | 30 | F6 | 98 |
| 61 | 92 | A2 | 80 | D1 | 24 | F7 | 80 |
| 62 | 99 | A3 | F8 | D2 | 79 | F8 | F8 |
| 63 | B0 | A4 | 83 | D3 | 40 | F9 | 83 |
| 64 | A4 | A5 | 92 | D4 | 98 | FA | 92 |
| 65 | F9 | A6 | 99 | D5 | 80 | FB | 99 |
| 66 | C0 | A7 | B0 | D6 | F8 | FC | B0 |
| | | A8 | A4 | D7 | 83 | FD | A4 |
| 70 | F8 | A9 | F9 | D8 | 92 | FE | F9 |
| 71 | 83 | AA | C0 | D9 | 99 | FF | C0 |
| 72 | 92 | | | | | | |
| 73 | 99 | | | | | | |

I/P = Input
O/P = Output

FIG. 3

TOKEN OPERATED TELEVISION TIMER

BACKGROUND

1. Field of the Invention

This invention is a timer device to control the time of operation of a television set, or other electric appliance. It is token activated, as tokens inserted into the device allocate time credit. When the allocated operating time has expired the appliance is turned off.

A control function for television is desireable in certain circumstances for economic or social reasons. It is a common practice to sell television time in closed circuit systems in locations such as hotels or airports. In the home the amount of time children spend watching television, or engaged in television related activities such as video games, can be a source of arguments between parents and children with parents wanting children to spend more time on schoolwork or physical activities.

A major problem with television time regulation systems that has not been addressed by prior art systems is the child's resentment at losing some of his independence regarding television time. The present invention is designed to minimize this resentment. It is based on a token allocation system. A child is allocated a number of tokens corresponding to an amount of television time. at the beginning of a given time period, say one week. During that week the scheduling of television time is completely under the control of the child. The parent does not become involved again until the beginning of the following week. Another feature of the present invention to maximize the child's acceptance of the device is an audible alert a convenient time, such as two minutes, before television time is terminated. The intent of the audible alert is to avoid unexpected cut-off of television operation.

2. Discussion of Prior Art

Pertinent prior art includes U.S. Pat. No. 4,588,901 to Maclay et al., May 13, 1986. There are a number of improvement differences offered by the present invention over the Maclay device.

Maclay invention uses a multi-contact keyswitch to input time credit information to the device. The present invention uses tokens to input time credit information to the device. The purpose of the token system is to maximize the effectiveness of the television time regulation function by maximizing the child's acceptance of it as explained in BACKGROUND-FIELD of INVENTION and OBJECTS and ADVANTAGES. A minor disadvantage of the token system is a larger vertical dimension required for the device case.

The present invention differs from the Maclay device in that the present invention has an audible alert a few minute before television operation is terminated in order to warn the child that his television time will soon be up.

In the Maclay device the counter measuring time of operation of the controlled electric appliance is turned on or off depending on the amount of electrical current flowing to the appliance. This is not a reliable method of operation as some appliances conduct standby current. Standby current is electric current to the appliance when the appliance is off. The standby current of one appliance can be greater than the operating current of a second appliance, thereby making reliable operation of the Maclay invention impossible. The present invention uses an on/off switch on the device housing to turn the controlled electrical appliance on and off.

The Maclay device uses a triac as the main power switch component conducting or not conducting power to the television set. The present invention uses a relay.

Other prior art television timer devices in addition to the Maclay device are effective only on selected frequency channels (U.S. Pat. No. 4,821,862 to Nelson, Apr. 18, 1989) or do not have the capability to retain time credit when the television is turned off (U.S. Pat. No. 3,879,332 to Leone, Apr. 22, 1975).

OBJECTS and ADVANTAGES

A major problem with television time regulation systems is the child's resentment at having his television time restricted. A prime objective of the present invention is to maximize the effectiveness of the system by maximizing the child's acceptance of it. To this end it is based on a token award system. Time credit information is input to the device via a token slot. The intended human interaction is that the parent gives a number of tokens, equivalent to an allocation of television time, to the child at the beginning of a time period such as one week. During that week use of the tokens and therefore the scheduling of television time is completely under the control of the child. The parent does not become involved again until the beginning of the following week when the tokens are recovered from the device, and another token allocation given to the child.

Another feature of the present invention to maximize the acceptance of the device by the child is an audible warning a pre-determined time period before operation of the television set is terminated. This is so that a child, who may be completely absorbed in a video game or television program, does not have the television set turned off unexpectedly.

The present invention uses a totally reliable method of determining when the controlled electric appliance is on and when it is off in contrast to some prior art devices as explained in BACKGROUND-DISCUSSION of PRIOR ART. The present invention can be put into the mode of operation where the controlled electrical appliance is on but the timer in the device is not running.

DESCRIPTION of DRAWINGS

FIG. 3 is a hexadecimal code listing for the read-only memory (68).

LIST of REFERENCE NUMERALS

Figure 1:
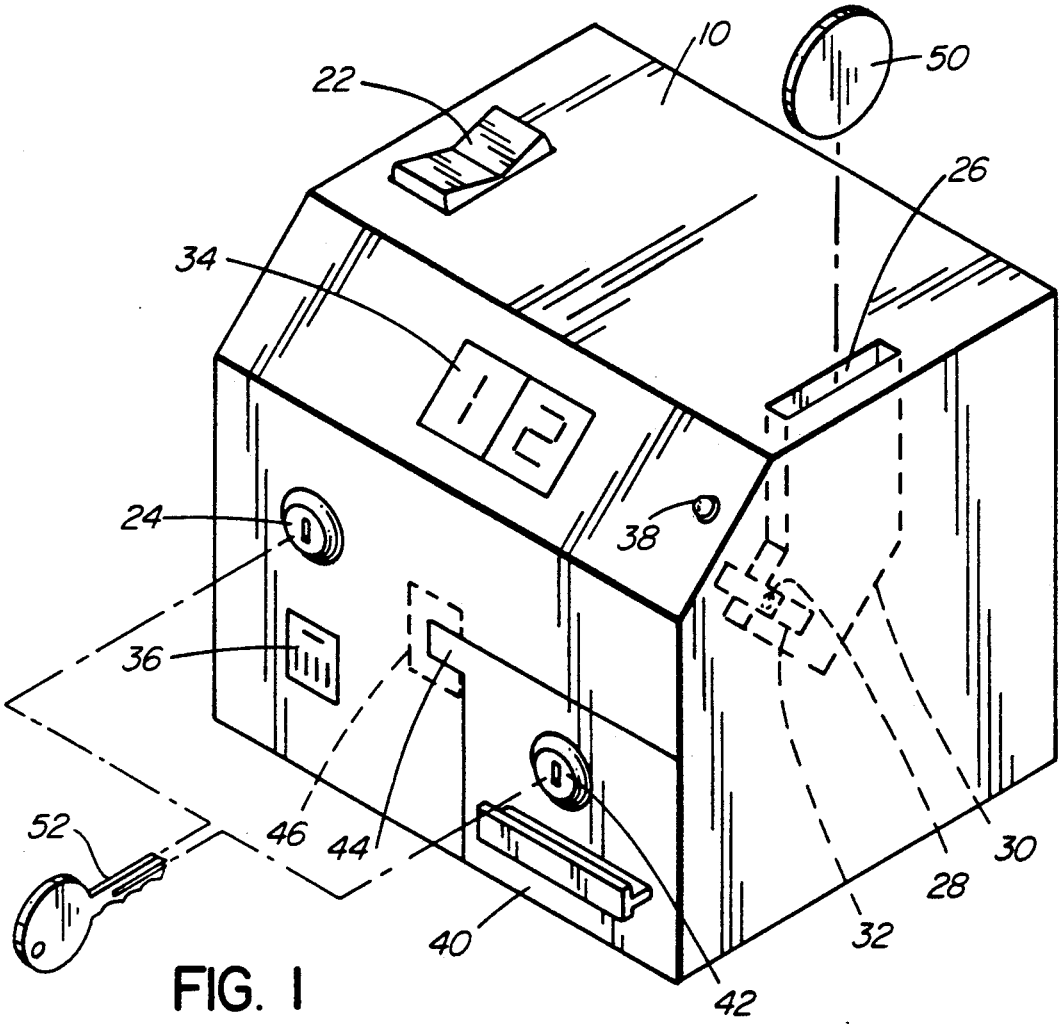
FIG. 1 is a perspective view of the present invention
Figure 1A:
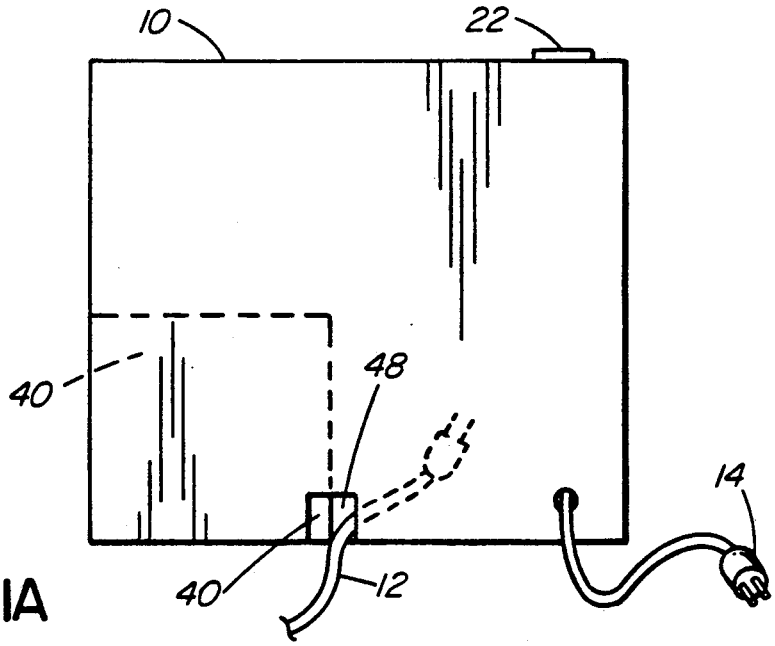
FIG. 1A is a rear view of the present invention
Figure 2:
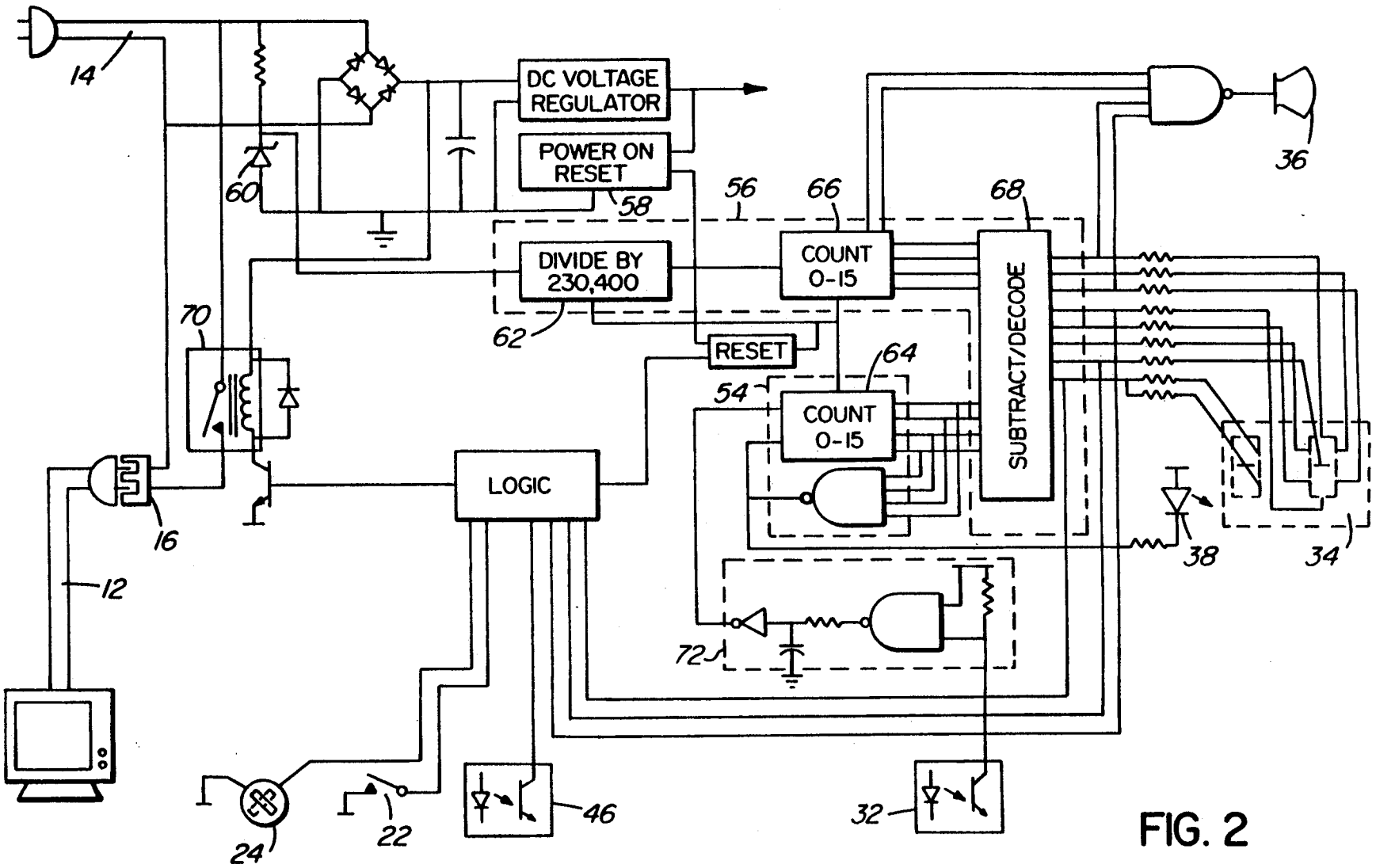
FIG. 2 is an electrical block diagram of the present invention

10 case
12 First power cord
14 Second power cord
16 Receptacle
22 On/off switch
24 Keyswitch
26 Token chute
28 Hole
30 Angle in token chute
32 Optointerrupter 1
34 Display
36 Audible alert
38 Drawer full indicator
40 Drawer 42 Drawer lock
44 Drawer lip
46 Optointerrupter 2
48 Cord secure slot
50 Token
52 Key
54 First counter
56 Second counter
58 Power on reset circuit
60 Zener diode
62 Divide by 230,400 circuit
64 Count 0–15
66 Count 0–15
68 Read-only memory
70 First switch
72 Pulse shaping circuit

DESCRIPTION of INVENTION

The present invention comprises a case (10) with a void into which a drawer (40) fits. The device receives electric power through a second power cord (14) that plugs into a conventional electric outlet. The first power cord (12) from the electrical appliance to be controlled is routed into the device through a cord secure slot (48) and then plugged into an electrical receptacle (16) inside the case (10).

Time credit information is input to the device by a token (50) dropped down a token chute (26). The token (50) falls out the bottom of the token chute (26) into the drawer (40). There is a hole (28) side-to-side through the token chute (26), located near the high edge of the token chute (26). Light normally shines through the hole (28) and is sensed on the other side. The interruption of that light indicates the passage of a token down the chute. The preferred embodiment of the light source and the light sensor is an optointerrupter (32), a U-shaped component incorporating both the light source and the light sensor. The optointerrupter is fixed to the token chute (26) and aligned to the hole (29) so that the light path of the optointerrupter is through the hole. There is an angle (30) in the token chute longitudinal axis, the angle (30) and hole (28) being aligned so that a thin object such as a knife blade cannot be inserted down the token chute (26) to interrupt the light beam.

The drawer (40) has a lock (42) to secure it in the case. The lock is operated by a key (52). The same key (52) operates an electrical keyswitch (24). There is a lip (44) on the drawer (40). When the drawer (40) is seated in the case (10) such that the lock (42) is engaged in the case (10), the lip (44) on the drawer fits between a light source and a light sensor to stop the passage of light between them. The preferred embodiment of the light source and the light sensor is an optointerrupter (46).

The passage of a token (50) down the token chute (26) is indicated on a display (34) that displays the numbers 0 to 15. The display (34) is seated in the case (10). The preferred embodiment of the display (34) is a light emitting diode 7 segment number display. When 15 tokens (50) have passed down the token chute (26) a drawer full indicator (38) is activated. The preferred embodiment of the drawer full indicator is a light emitting diode.

The controlled appliance can be turned off at any time by an on/off switch (22) seated in the case (10). The on/off switch (22) acts to open circuit a first switch (70), which is in series with the path of electric current to the controlled appliance. The preferred embodiment of the first switch (70) is a relay.

An audible alert is activated a short time before the controlled appliance will be turned off. The preferred embodiment of the audible alert is a buzzer (36) seated in the case (10).

The non-obvious components in the electronic section of the device are a first counter (54), a second counter (56), a power on reset circuit (58), a zener diode (60), a count 0–15 circuit (64), and a pulse shaping circuit (72). The second counter (56) consists of a divide by 230,400 circuit (62), a count 0–15 circuit (66) and a read-only memory circuit (68). The electronic section is connected by wires to the first power cord (12), the electrical receptacle (16), the on/off switch (22), the keyswitch (24), optointerrupter 1 (32), the display (34), the drawer full indicator (38), optointerrupter 2 (46) and the first switch (70).

OPERATION of INVENTION

To connect the device for operation the first power cord (12) from the electrical appliance to be controlled is plugged into the electrical receptacle (16). The second power cord (14) is plugged into an electric outlet. When electric power is first applied to the device through the second power cord (14), the power on reset circuit (58) sets all counters to zero. To operate the device the drawer (40) must be fully seated in the case (10) such that the lip (44) on the drawer is interrupting the light across the gap of optointerrupter 2 (46). If the drawer is withdrawn from the case, light is sensed by optointerrupter 2 (46), and all counters are reset to zero and held there until the drawer (40) is again fully seated in the case (10).

A token (50) passing down the token chute (26) is detected as an absence of light across the gap of optointerrupter 1 (32). The electric signal from the light sensor of optointerrupter 1 (32) passes through a pulse shaping circuit (72) that has a time constant such as to ensure that the passing token is counted once but only once.

A first counter circuit (54) counts the number of tokens that have passed down the token chute (26) into the drawer (40) up to a maximum number of 15. When 15 tokens have been counted the first counter (54) is disabled so that it cannot count higher, and the drawer full indicator (38) comes on.

The 60 Hz line voltage waveform is limited in amplitude by the zener diode (60), forming the clock input to the second counter (56). The second counter (56) consists of a divide by 230,400 circuit (62), a count 0–15 circuit (66), and a read-only memory (68). The divide by 230,400 circuit (62) gives an output signal after 64 minutes. The count 0–15 circuit (66) counts the number of elapsed 64 minute time periods. This number is subtracted from the number of tokens in the drawer, and that remaining time number is displayed (34). The subtraction operation and the decode function to drive the display (34) are effectively carried out in the read-only memory (68), by means of the data pattern stored in the read-only memory (68) described in hexadecimal code form in FIG. 3.

When the remaining time number is zero, electric power to the television set is removed by open circuiting the first switch (70).

There is a two position on/off switch (22) on the case, the purpose of which is to turn the television set on and off, retaining time credit when the television set is off. It is connected so that when the remaining time number is any number other than zero with the switch in position one the divide by 230,400 circuit (62) operates, and power is supplied to the television set with the switch in position two the divide by 230,400 circuit (62) does not operate, and the television set is off.

There is a two position switch (24) operated by a key, the purpose of which is to allow the person with the key to use the television set without using up time credit. It is connected so that when the remaining time number is any number other than zero with the switch in position one the divide by 230,400 circuit (62) operates with the switch in position two the divide by 230,400 circuit (62) does not operate.

There is an audible alert (36) which is activated a predetermined time such as two minutes before television operation is cut off. The purpose of this indicator is to inform the user that television operation is about to be terminated. The time to turn on the audible alert is decoded from the second counter circuit (56).

A person skilled in the art understanding this invention may now conceive of alternate embodiments or variations. All are considered to be within the sphere and scope of this invention as defined in the claims appended hereto.

Without limiting the generality of the preceding paragraph, this invention encompasses alternative methods of inputting time credit information. Instead of the token and token channel system described above, time credit information can be input by means of a switch or switches, or cards that are mechanically or magnetically coded. Without limiting the generality of the preceding paragraph, this invention encompasses alternative methods of realizing the electronics section. The electronic functions of this invention can be based on a microprocessor.

CONCLUSIONS, RAMIFICATIONS AND SCOPE OF INVENTION

The present invention is a token operated timer that controls the on/off operation of a wide range of electrical appliances including television sets. It is primarily intended to regulate the television time of children whose parents are concerned that they are spending too much time watching television or playing video games, to the detriment of schoolwork or excercise.

The token operation of this device is part of a conceptual system that invests a maximum degree of control of the device with the child, and distances the parent from it. This makes the system substantially more effective than prior art systems by minimizing the child's natural resentment at having his television time restricted.

The present invention is a unique device that represents a significant advance in the field of television time regulation systems.

We claim:

1. A device for measuring and controlling the time an electrical appliance receiving power through a first power cord is used, comprising (a) a first counter including means to set a time period on said first counter indicating the total time said electrical appliance can be used (b) a second counter to measure the operational time which is the time said electrical appliance has operated, and to generate the remaining time which is said time period on said first counter minus said operational time (c) means operable to prevent said second counter from measuring said operational time (d) means operable to remove electric current from said electrical appliance when either a first switch is in one of two possible positions, or said remaining time is zero (e) a case enclosing said device (f) a second power cord to supply electric power to said device (g) an indicator visually indicating said remaining time (h) a token means to increment said first counter when a token is inserted into said case, said token means comprising said token a chute fastened to said case and located in said case so that said token can be inserted into said chute from the top of said case and then roll down said chute, the cross sectional dimensions of said chute being just large enough to allow passage of said token said chute having a small hole straight through from side to side a source of light located so that light continually passes through said hole unless stopped by an intervening object a light sensor located so that it senses light passing through said hole an electronic means to increment said first counter when light ceases to pass through said hole a drawer fitting into said case below the bottom of said chute so that said tokens passing down said chute fall into said drawer a means of determining when said drawer has been withdrawn from said case, and electronic means of setting said first counter and said second counter to zero when said drawer has been withdrawn from said case.

2. The device of claim 1 including an electrical receptacle for receiving and transmitting electric current to said first power cord.

3. The device of claim 2 including means to set said first counter and said second counter to zero when said second power cord is inserted into a conventional power outlet.

4. The device of claim 3 including said chute having one angle in its longitudinal axis, said chute said case and said hole positioned so that an object cannot be easily inserted down said chute from outside said case to stop the passage of light through said hole.

5. The device of claim 3 including a lock attached to said drawer and located such that it prevents said drawer from being withdrawn from said case when said lock is in the locked position, said lock to be operated by a key.

* * * * *